US011808278B2

(12) United States Patent
Klepsvik et al.

(10) Patent No.: US 11,808,278 B2
(45) Date of Patent: Nov. 7, 2023

(54) BEARING SYSTEM FOR VERTICAL SHAFTS

(71) Applicant: ONESUBSEA IP UK LIMITED, London (GB)

(72) Inventors: Knut Harald Klepsvik, Kolltveit (NO); Anders Brunvold, Blomsterdalen (NO)

(73) Assignee: OneSubsea IP UK Limited, Sugar Land, TX (US)

( * ) Notice: Subject to any disclaimer, the term of this patent is extended or adjusted under 35 U.S.C. 154(b) by 294 days.

(21) Appl. No.: 16/410,871

(22) Filed: May 13, 2019

(65) Prior Publication Data

US 2020/0362871 A1 Nov. 19, 2020

(51) Int. Cl.
*F04D 29/047* (2006.01)
*F04D 13/10* (2006.01)
*F04D 3/00* (2006.01)

(52) U.S. Cl.
CPC ..... *F04D 29/0476* (2013.01); *F04D 3/00* (2013.01); *F04D 13/10* (2013.01)

(58) Field of Classification Search
CPC .... F04D 13/10; F04D 29/047; F04D 29/0473; F04D 29/0476; F16C 17/03; F16C 17/035; F16C 32/0666
See application file for complete search history.

(56) References Cited

U.S. PATENT DOCUMENTS 6,739,756 B2 * 5/2004 Miller ..... F16C 33/1075 384/309
2013/0028731 A1 * 1/2013 Mimura ..... F16C 17/03 384/309
2017/0130730 A1 * 5/2017 Torkildsen ..... F04D 19/024
2018/0119737 A1 * 5/2018 Kjellnes ..... F04D 29/0473

* cited by examiner

*Primary Examiner* — Courtney D Heinle
*Assistant Examiner* — Danielle M. Christensen
(74) *Attorney, Agent, or Firm* — Jeffrey D. Frantz

(57) ABSTRACT

A vertical rotating system that includes a first vertical shaft that rotates. The first vertical shaft is oriented such that the gravitational force is substantially parallel to the first vertical shaft. A radial bearing extends about a first portion of the first vertical shaft. A first impeller sectioned couples to the first vertical shaft and rotates in a first direction to pump a first fluid. A first stator surrounds the first vertical shaft. The first stator defines a first groove that extends about a second portion of the first vertical shaft. The first groove receives a second fluid. A pressure of the second fluid drives the first vertical shaft away from the first groove.

17 Claims, 8 Drawing Sheets

BEARING SYSTEM FOR VERTICAL SHAFTS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to read in this light, and not as admissions of prior art.

Wells are drilled to extract oil and/or gas from subterranean reserves. These resources are extracted from the wellbore through a wellhead that couples to the end of the wellbore. The flow of oil and/or gas out of the well is typically controlled by one or more valves on the wellhead. After flowing through the wellhead, the flow of oil and/or gas may be directed to a compressor that pumps the oil and/or gas to the surface, in a subsea environment, and/or pumps the fluid flow to another location, such as a refinery. Unfortunately, the vertically oriented shafts of these pumps or compressors may not be preloaded. In other words, the vertically oriented shafts may not have a force acting substantially perpendicular to their longitudinal axis that loads and stabilizes the shaft. These pumps or compressors with unloaded vertically oriented shafts may therefore experience rotor whirl or other rotor dynamic effects. Over time, rotor whirl may wear these vertically oriented pumps or compressors, which may result in reduced performance and/or increased maintenance.

BRIEF SUMMARY

In one embodiment, a vertical rotating system that includes a first vertical shaft that rotates. The first vertical shaft is oriented such that the gravitational force is substantially parallel to the first vertical shaft. A radial bearing extends about a first portion of the first vertical shaft. A first impeller sectioned couples to the first vertical shaft and rotates in a first direction to pump a first fluid. A first stator surrounds the first vertical shaft. The first stator defines a first groove that extends about a second portion of the first vertical shaft. The first groove receives a second fluid. A pressure of the second fluid drives the first vertical shaft away from the first groove.

In another embodiment, a vertical rotating system that includes a first vertical shaft that rotates about a central axis of the first vertical shaft. The first vertical shaft is oriented such that the gravitational force is substantially parallel to the first vertical shaft. A first impeller section couples to the first vertical shaft and rotates in a first direction. A stator surrounds the first vertical shaft. A plurality of bearing pads that extend circumferentially about the first vertical shaft. The plurality of bearing pads couple to the stator with a respective pivot connector of a plurality of pivot connectors. The plurality of bearing pads direct a force created by rotation of the first vertical shaft in a fluid to load the first vertical shaft.

In another embodiment, a contra-rotating compressor that includes a first vertical shaft that rotates about a first central axis of the first vertical shaft. The first vertical shaft is oriented such that the gravitational force is substantially parallel to the first vertical shaft. A first impeller section couples to the first vertical shaft and rotates in a first direction. A second vertical shaft rotates about a second central axis of the second vertical shaft. The second vertical shaft is oriented such that the gravitational force is substantially parallel to the second vertical shaft. A second impeller section rotates in a second direction that is opposite the first direction. The first and second impeller sections are axially aligned. A bearing system loads the first vertical shaft and/or the second vertical shaft.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
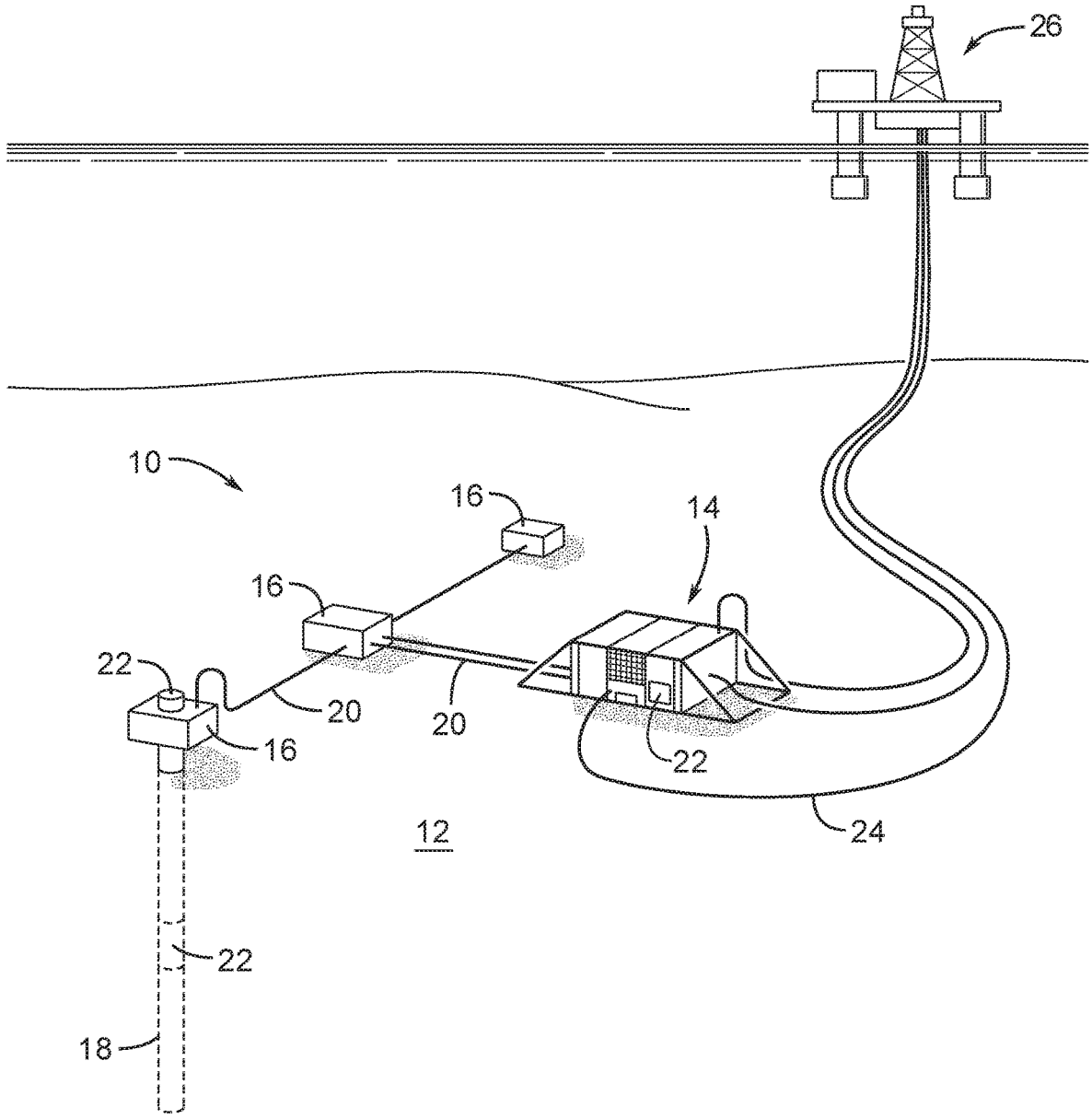
FIG. 1 is a schematic illustration of a mineral extraction system with a vertically oriented compressor, according to an embodiment of the disclosure.

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, and components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The discussion below relates to vertically oriented compressors, such as contra-rotating wet gas compressors. Contra-rotating wet gas compressors include inner and outer impeller sections that couple to separate shafts that rotate in opposite directions. The impeller sections are arranged so that alternating impeller sections rotate in opposite directions. This may enable the compressor to operate without static diffusers between the rotating impeller sections. Each impeller section includes impeller blades that rotate with the impeller sections. As the impeller blades rotate they transfer mechanical energy to the fluid (e.g., oil and/or gas), which compresses and drives the fluid through the contra-rotating wet gas compressor.

Each of these impeller sections couples to and is driven by a vertically oriented shaft. As these vertically oriented shafts rotate, the shafts may experience rotor dynamic effects, such as rotor whirl. In order to block and/or reduce these rotor dynamic effects these vertically oriented compressors include a bearing system. The bearing system creates a force (e.g., load) on the vertically oriented shafts that is perpendicular to or substantially perpendicular to the longitudinal axis of the vertically oriented shafts). In operation, the force drives the vertically oriented shafts toward a bearing, which blocks and/or reduces movement of the vertically oriented shafts as they rotate. In other words, the force generated by the bearing system blocks and/or reduces undesirable rotor dynamic effects, such as rotor whirl. As will be explained below, the bearing system may use a pressurized fluid to create the force on a vertically oriented shaft or the bearing system may use a series of bearing pads to generate and focus a force toward a vertically oriented shaft. In the discussion below, the term vertically oriented shaft is intended to describe shafts that are parallel to or substantially parallel to gravity vectors.

FIG. 1 is a schematic of a mineral extraction system 10 in a subsea environment. In some embodiments, to extract oil and/or natural gas from the sea floor 12, the mineral extraction system 10 may include a subsea station 14. The subsea station 14 is positioned downstream from one or more wellheads 16 that couple to wells 18. After drilling the wells 18, hydrocarbons (e.g., oil, gas) flow through the wells 18 to the wellheads 16. The hydrocarbons then flow from the wellheads 16 through jumper cables 20 to the subsea station 14. The subsea station 14 includes a compressor module 22, which may be powered by an electric motor, such as an induction motor or permanent magnet motor. The compressor module 22 may include one or more vertical rotating systems (e.g., contra rotating wet gas compressor) that pump oil and/or natural gas to the surface.

The subsea station 14 is connected to one or more flow lines, such as flow line 24. As illustrated, the flow line 24 couples to a platform 26, enabling oil and/or gas to flow from the wells 18 to the platform 26. In some embodiments, the flow lines 24 may extend from the subsea station 14 to another facility such as a floating production, storage and offloading unit (FPSO), or a shore-based facility. The flow lines 24 can also be used to supply fluids, as well as include control and data lines for use with the subsea equipment. In operation, the compressor module 22 pumps oil and/or natural gas from the subsea station 14 to the platform 26 through the flow line 24. In some embodiments, the compressor module 22 may also be located downhole, or in a subsea location such as on the sea floor in a Christmas tree at a wellhead 16.

It should be understood that the compressor module 22 may be configured for other subsea fluid processing functions, such as a subsea pumping module, a seawater injection module, and/or a subsea separator module. It should also be understood that the compressor module 22 may pump single-phase liquids, single-phase gases, or multiphase fluids.

Figure 2:
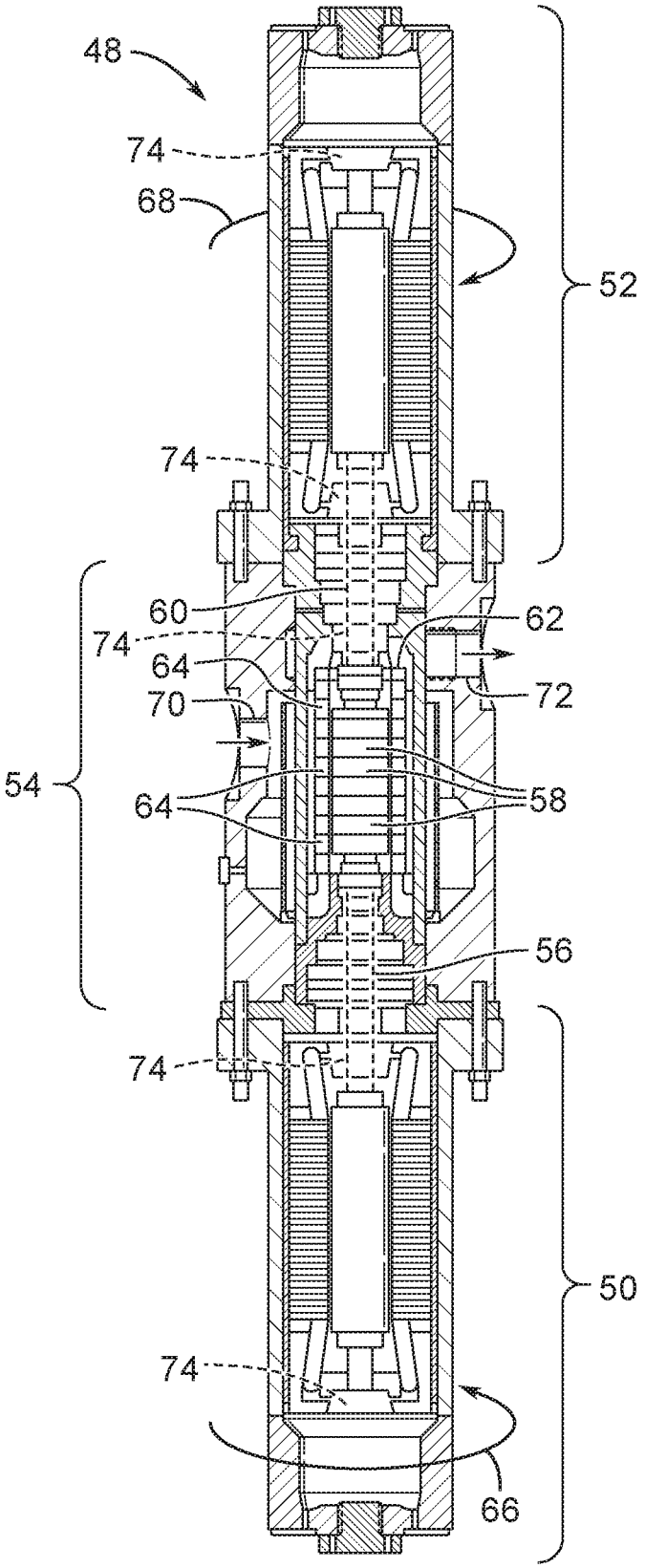
FIG. 2 is a cross-sectional view of a vertically oriented compressor, according to an embodiment of the disclosure.

FIG. 2 is a cross-sectional view showing further details of a contra-rotating wet gas compressor 48 (e.g., vertical rotating system) of the compressor module 22. The contra-rotating wet gas compressor 48 includes a first motor 50, a second motor 52, and a contra-rotating compressor section 54. In operation, the first motor 50 drives a vertically oriented shaft 56 that rotates a plurality of inner impeller sections 58 within the compressor section 54. Similarly, the second motor 52 drives a vertically oriented vertically oriented shaft 60 that rotates an outer sleeve 62 within the compressor section 54. The outer sleeve 62 couples to and rotates a plurality of outer impeller sections 64. In operation, the first motor 50 rotates the inner impeller sections 58 in a first direction, while the second motor 52 rotates the outer impeller sections 64 in a second direction. For example, the first motor 50 may rotate the inner impeller sections 58 in counterclockwise direction 66, while the second motor 52 rotates the outer impeller sections 64 in clockwise direction 68. It should be understood that the rotational directions of the inner impeller sections 58 and the outer impeller section 64 may be switched depending on the embodiment. As the inner impeller sections 58 and the outer impeller section 64 rotate in opposite directions fluid is pumped through the contra-rotating wet gas compressor 48 from an inlet 70 to an outlet 72, enabling the contra-rotating wet gas compressor 48 to pump multiphase fluids without stationary impellers to control and drive fluid flow.

In order to block and/or reduce undesirable rotor dynamic effects, such as rotor whirl, the compressor 48 includes one or more bearing systems 74 that load the vertically oriented shafts 56 and 60. For example, the compressor 48 may include two or more bearing systems 74 that create loads at different positions along the length of the shafts 56 and 60. By loading the shafts 56 and 60 at different points, the bearing systems 74 may further reduce and/or block undesirable rotor dynamic effects of the shafts 56 and 60.

Figure 3:
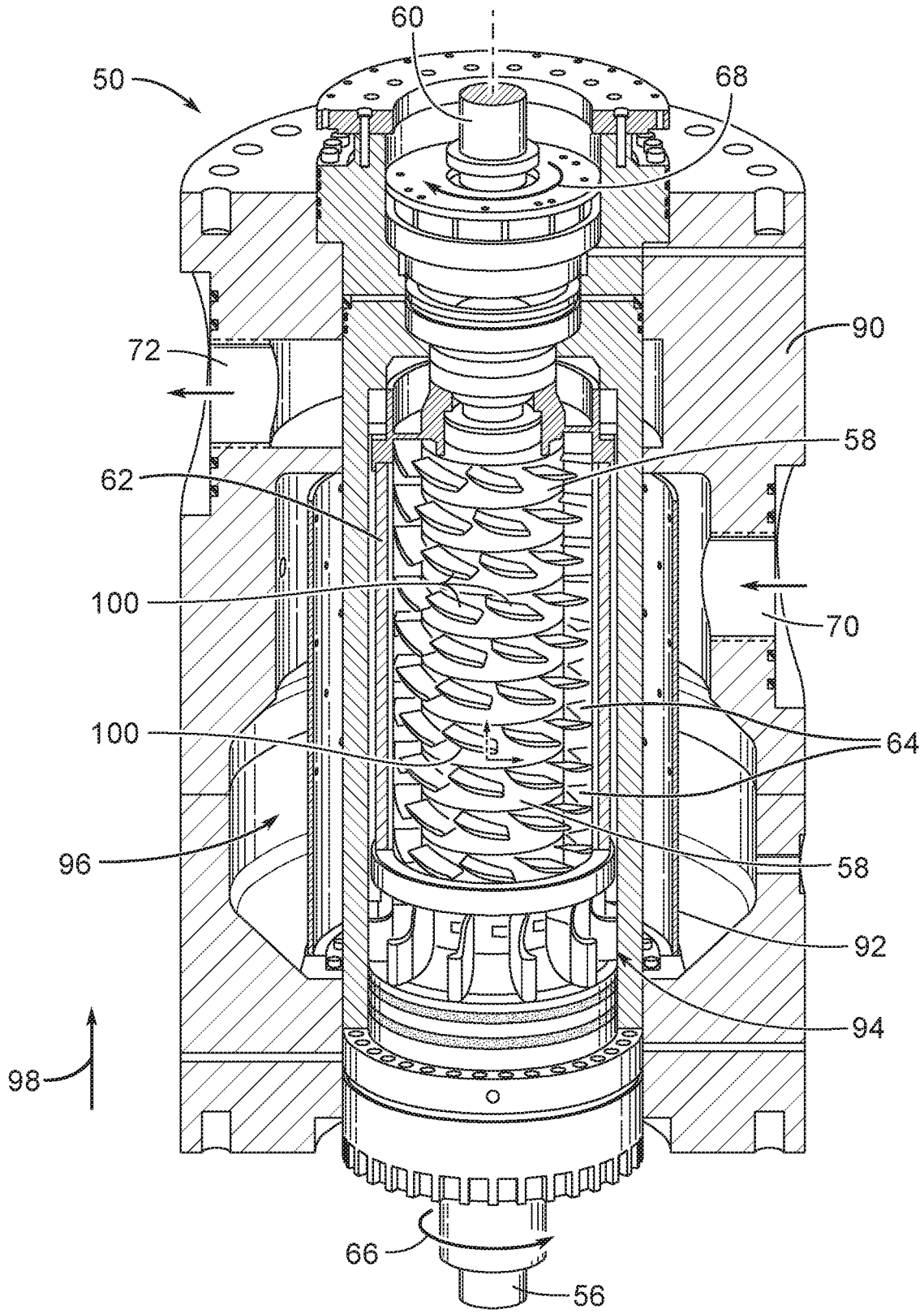
FIG. 3 is a partial cross-sectional view of a vertically oriented compressor, according to an embodiment of the disclosure.
Figure 4:
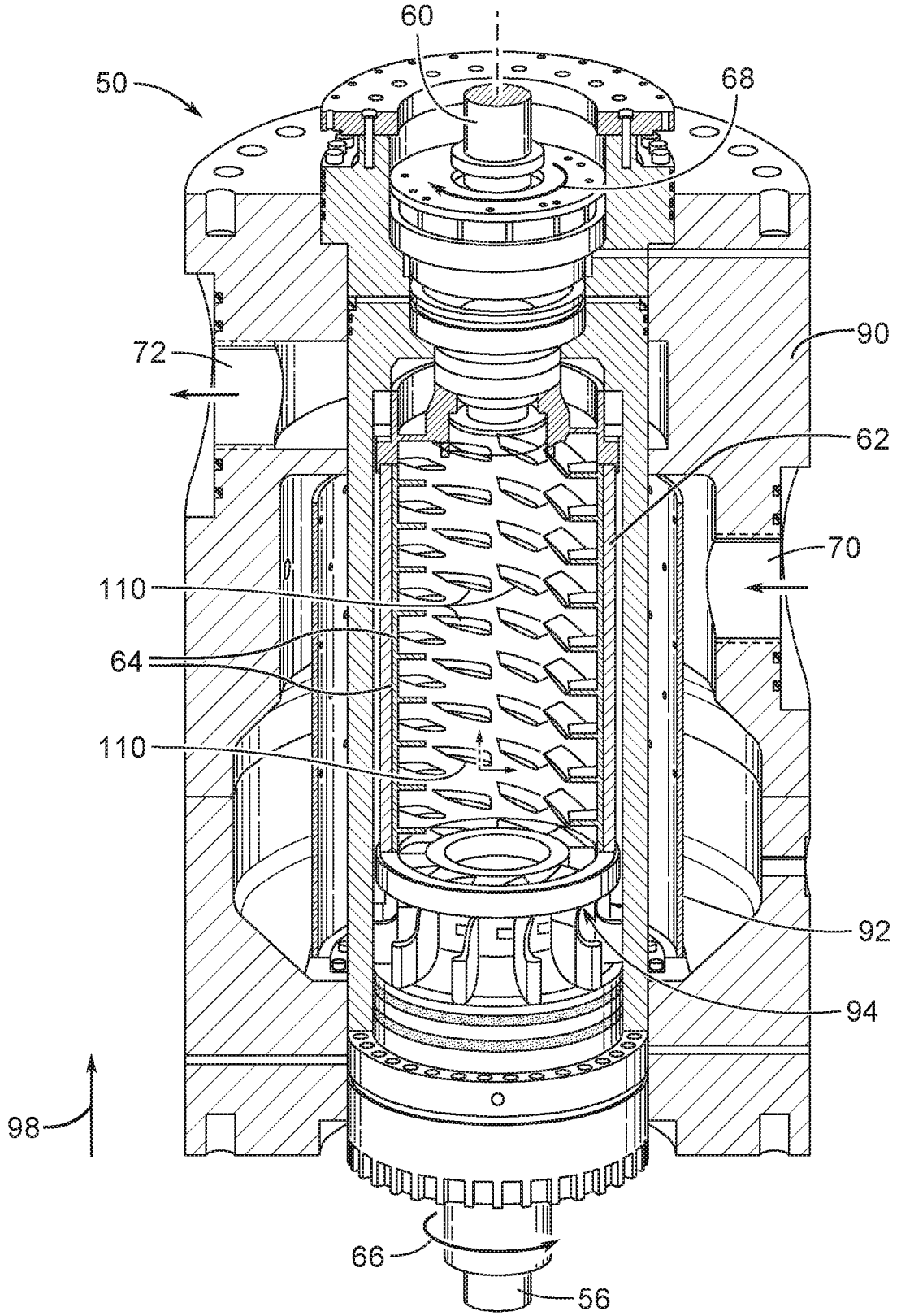
FIG. 4 is a partial cross-sectional view of a vertically oriented compressor, according to an embodiment of the disclosure.

FIGS. 3 and 4 are partial cross-sectional views of the compressor section 54 of the contra-rotating wet gas compressor 48. As illustrated, fluid (e.g., mixture of fluids) enters the compressor section 54 via the inlet 70 in the housing 90. The fluid then passes around and/or through a perforated wall 92 and through a manifold 94 where it enters an impeller unit 96 from the bottom in direction 98. The impeller unit 96 includes the alternating rows of inner impeller sections 58 and outer impeller sections 64. In operation, the inner impeller sections 58 and outer impeller section 64 are driven/rotate in opposite directions to drive the fluid in direction 98. As the fluid progresses through the alternating rows of inner impeller section 58 and outer impeller section 64, in direction 98, the fluid is compressed to increasingly higher pressures. In other words, because the inner impeller sections 58 and the outer impeller sections 64 are alternatingly stacked and rotate in opposite directions, each inner impeller section 58 and outer impeller section 64 effectively forms a separate stage of the impeller unit 96. After passing through these stages of inner impeller sections 58 and outer impeller sections 64, the compressed fluid is directed through an outlet 72 in the housing 90. The fluid may then enter flow line 24 for transmission.

The vertically oriented shaft 56 couples to the plurality of inner impeller sections 58 within the compressor section 54. As the vertically oriented shaft 56 rotates in counterclockwise direction 66, the vertically oriented shaft 56 rotates the inner impeller section 58 in counterclockwise direction 66. The rotation of the inner impeller section 58 rotates a plurality of impeller blades/airfoils 100 coupled to each inner impeller section 58. It is these impeller blades/airfoils 100 that drive and compress the fluid.

FIG. 4 illustrates a partial cross-sectional view of the compressor section 54 with the inner impeller sections 58 removed. As explained above, the second motor 52 rotates the vertically oriented vertically oriented shaft 60. For example, the second motor 52 may rotate the vertically oriented vertically oriented shaft 60 in a clockwise direction 68. As the vertically oriented vertically oriented shaft 60 rotates, it rotates outer sleeve 62. The outer sleeve 62 couples to the outer impeller sections 64 and therefore rotates the outer impeller sections 64 in clockwise direction 68. As illustrated, each of the outer impeller hub section 64 includes a plurality of impeller blades/airfoils 110.

Figure 5:
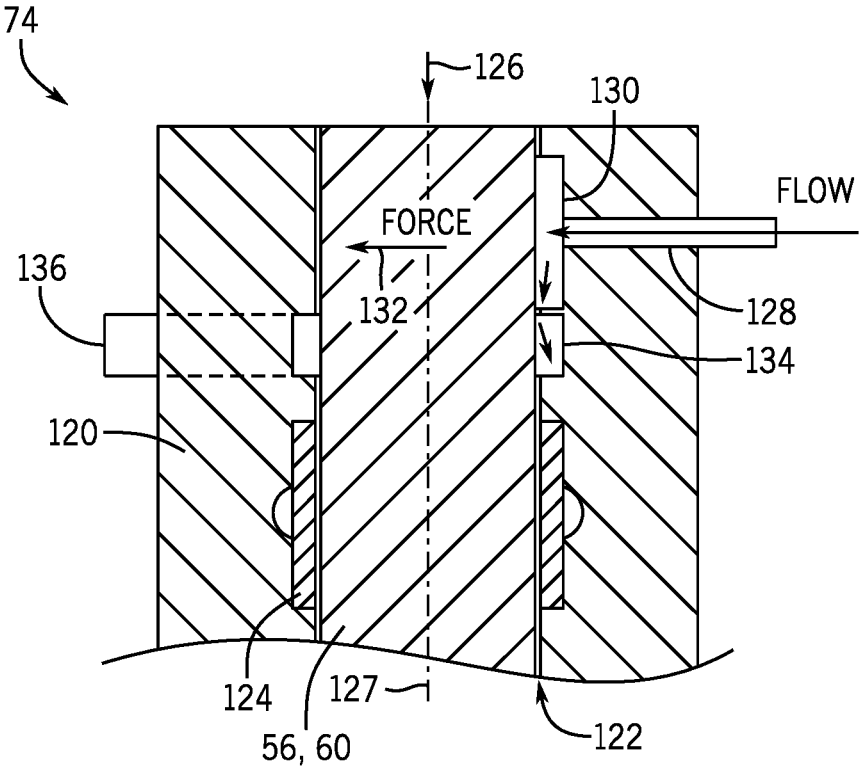
FIG. 5 is a cross-sectional side view of a bearing system for a vertically oriented shaft, according to an embodiment of the disclosure.

FIG. 5 is a cross-sectional side view of a bearing system 74 for a vertically oriented shaft 56, 60. The bearing system 74 includes a stator 120 that defines a cavity 122 that receives the vertically oriented shaft 56, 60. The stator 120 supports a bearing 124 that reduces the friction created by rotation of the vertically oriented shaft 56, 60. The bearing 124 may completely surround the vertically oriented shaft 56, 60 or a portion thereof. For example, the bearing 124 may include multiple pieces (e.g., 1, 2, 3, 4) that extend about the shaft 56, 60.

As explained above, the shaft 56, 60 is vertically oriented. That is, the shaft 56, 60 may be parallel to or substantially parallel to gravity vectors, such as gravity vector 126. The vertical orientation of the shaft 56, 60 may enable undesirable rotor dynamic effects (e.g., rotor whirl) as the shaft 56, 60 rotates. To reduce and/or block these undesirable rotor dynamic effects, the bearing system 74 directs a pressurized fluid into contact with the shaft 56, 60. The force of the fluid on the shaft 56, 60 blocks and/or reduces movement of the shaft 56, 60 that is perpendicular or substantially perpendicular to a longitudinal axis 127 of the cavity 122 (e.g., rotor whirl).

In order to direct the fluid into contact with the shaft 56, 60, the stator 120 defines a conduit 128 that receives the pressurized fluid. In some embodiments, the pressurized fluid may be a pressurized fluid (e.g., oil) used in the motors 50, 52. In other embodiments, the pressurized fluid may be the same fluid pressurized by the compressor 48. For example, a portion of the pressurized fluid exiting the outlet 72 of the compressor 48 may be directed to the stator 120 where it enters the conduit 128.

After flowing through the conduit 128, the fluid enters a chamber 130 that extends about the shaft 56, 60. The chamber 130 does not extend about the entire circumference of the shaft 56, 60 in order to create force in a specific direction. For example, the chamber 130 may extend between 1-270 degrees, 10-150 degrees, 50-100 degrees about the circumference of the shaft 56, 60. As the pressure of the fluid builds in the chamber 130, the fluid exerts a force that drives the shaft 56, 60 in direction 132. This force then controls the position of the shaft 56, 60 within the stator 120. After entering the chamber 130, some of the fluid may exit the chamber 130 and flow into one or more secondary chambers 134. The secondary chambers 134 may be on one or both sides of the chamber 130 along the axis of the shaft 56, 60. The secondary chambers 134 may extend completely about the shaft 56, 60. As the secondary chamber 134 receives the pressurized fluid, it creates a pressure pocket that encompasses the shaft 56, 60 equalizing the forces acting on the shaft 56, 60 over the length 136 of the secondary chamber 134. By including the secondary chamber 134 the bearing system 74 may provide a stabilizing force that may block excess movement of the shaft 56, 60 in direction 132 created by the pressure of the fluid in the chamber 130.

Figure 6:
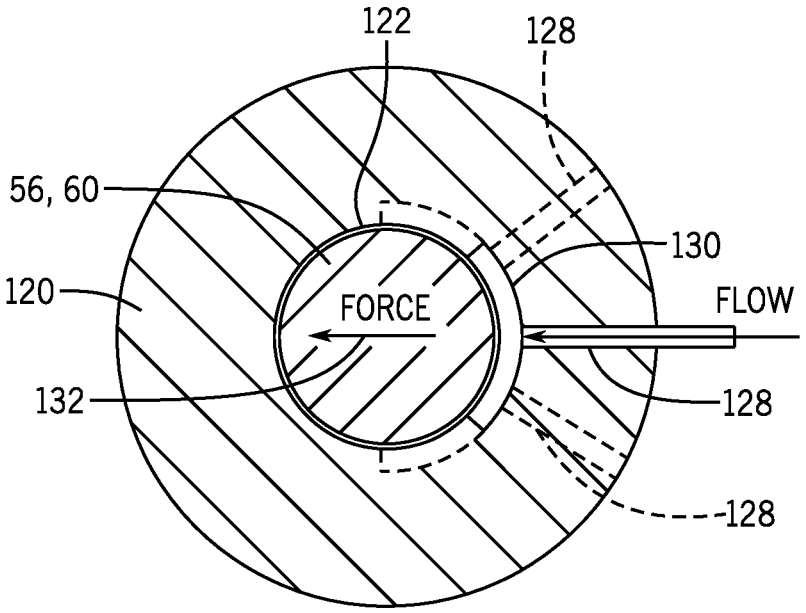
FIG. 6 is a cross-sectional top view of the bearing system in FIG. 5 for a vertically oriented shaft, according to an embodiment of the disclosure.

FIG. 6 is a cross-sectional top view of the bearing system 74 in FIG. 5. As illustrated, the chamber 130 does not extend completely around the circumference of the shaft 56, 60. By extending about a portion of the shaft 56, 60 the pressure of the fluid flowing through the stator 120 is able to drive the shaft 56, 60 in direction 132. The chamber 130 may extend 1-180 degrees, 20-160 degrees, 40-140 degrees, 60-120 degrees about the circumference of the shaft 56, 60. In some embodiments, the bearing system 74 may include additional conduits 128 in the stator 120 that feed pressurized fluid into the chamber 130. For example, the bearing system 74 may include 1, 2, 3, 4, 5, or more conduits 128.

Figure 7:
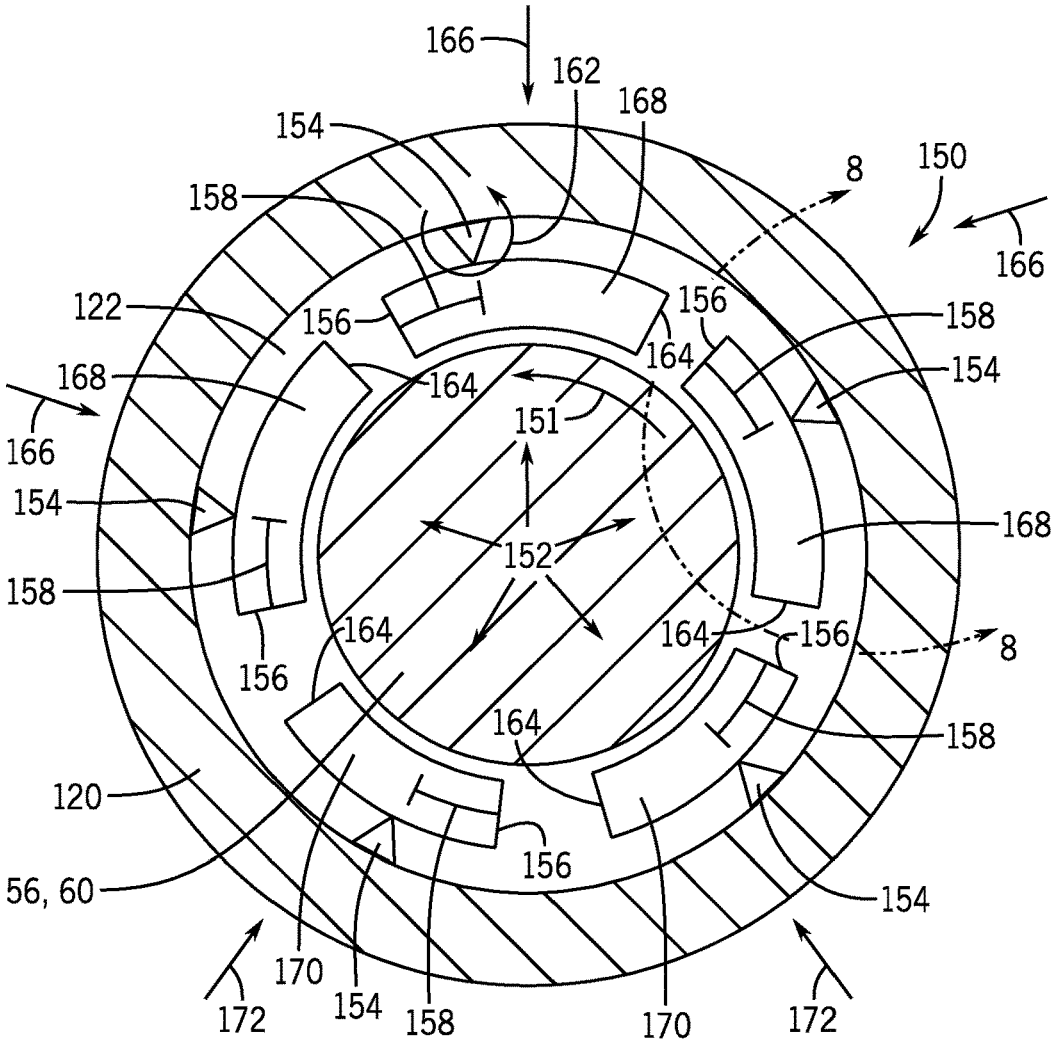
FIG. 7 is a cross-sectional top view of a bearing system for a vertically oriented shaft, according to an embodiment of the disclosure.

FIG. 7 is a cross-sectional top view of a bearing system 150 that uses rotation of the shaft 56, 60 in a fluid to create a pressure gradient with bearing pads 152, which drives the shaft 56, 60 in a desired direction. In other words, the bearing system 150 uses the pressure gradient to load the shaft 56, 60 in a specific direction. During this discussion of FIG. 7, FIG. 8 will also be referenced to facilitate the discussion. As explained above, the shaft 56, 60 is vertically oriented within the cavity 122 of the stator 120. During operation, the shaft 56, 60 rotates in a fluid (e.g., oil) contained within the cavity 122. The fluid may be a lubricating fluid that reduces friction between the shaft 56, 60 as well as blocks particulate from entering the cavity 122. In order to create a pressure gradient within the stator 120 that drives the shaft 56, 60 in a direction that is perpendicular to or substantially perpendicular to the longitudinal axis of the shaft 56, 60, the bearing system 150 includes bearing pads 152 (e.g., 1, 2, 3, 4, 5, or more). The bearing pads 152 couple to the stator 120 with respective pivot connectors 154. The pivot connectors 154 may be offset from a center of the respective bearing pads 152. By offsetting the pivot connector 154 from the center of the bearing pads 152, the pivot connector 154 facilitates rotation of the bearing pad 152. As illustrated, each pivot connector 154 is offset from a first outermost edge 156 (e.g., counter-clockwise edge) by a distance 158. The distance 158 is the same for each of the bearing pads 152.

Figure 8:
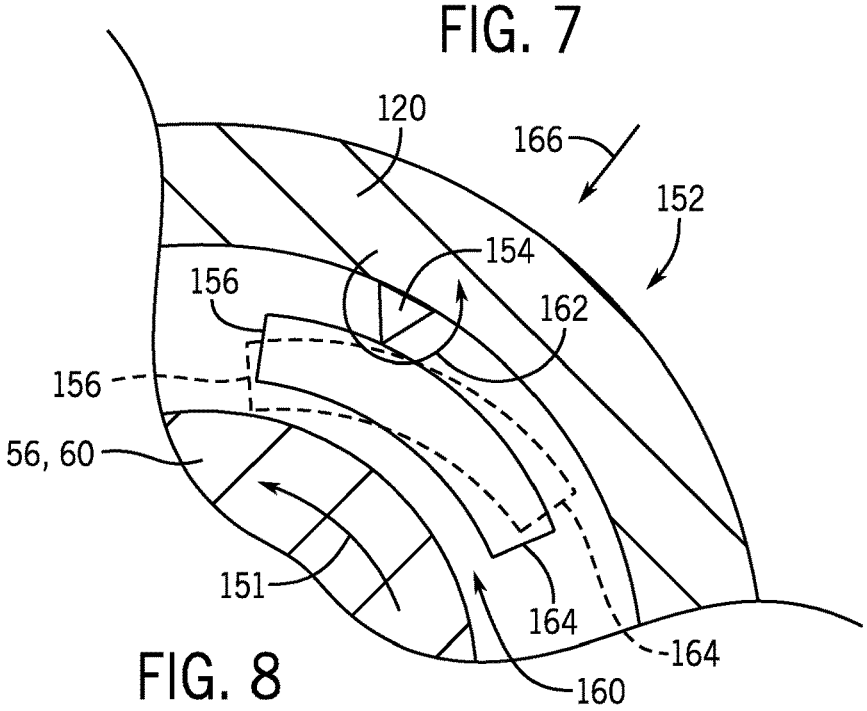
FIG. 8 is a partial cross-sectional view of the bearing system within line 8-8 of FIG. 7.

In operation, the shafts 56, 60 rotate within the stator 120, which drives rotation of the compressor section 54. As the shaft 56, 60 rotates (e.g. rotates in counterclockwise direction 151) the fluid in the cavity 122 adheres to the outer surface of the shaft 56, 60. The fluid is then dragged between the shaft 56, 60 and the bearing pads 152. The force of the fluid contacting the bearing pads 152 (i.e., contacting a face of the bearing pads 152 that faces the shaft 56, 60) drives rotation of the bearing pads 152 about the pivot connector 154. As illustrated in FIG. 8, the fluid dragged by the shaft 56, 60 enters a gap 160 between the bearing pad 152 and the shaft 56, 60. The force of the fluid entering this gap 160 drives rotation of the bearing pad 152 in the counterclockwise direction 162 about the pivot connector 154. As the bearing pad 152 rotates, the gap 160 increases in size at a second outermost edge 164 (e.g., clockwise edge) and decreases in size along the length of the bearing pad 152 to the first outermost edge 156. The decrease in the gap 160 increases the pressure of the fluid proximate the pivot connector 154 creating a force that drives the shaft 56, 60 in direction 166.

Returning to FIG. 7, three of the bearing pads 152 (i.e., bearing pads labeled 168) are the same size and two of the bearing pads 152 (i.e., bearing pads labeled 170) are smaller/shorter. The smaller size of the bearing pads 170 reduces the force created by the fluid as it is dragged by the shaft 56, 60 into the gap 160. Because the forces created by the bearing pads 170 is less than the force created by the bearing pads 168, the bearing system 150 drives the shaft 56, 60 toward the bearing pads 170. In this way, the bearing system 150 loads or biases the shaft 56, 60 in a desired direction to reduce rotor dynamic effects (e.g., rotor whirl).

While the bearing system 150 includes two bearing pads 152 (i.e., bearing pads labeled 170) that are smaller/shorter than the remaining bearing pads 152, it should be understood that the number of smaller/shorter bearing pads to larger/longer bearing pads may change. For example, the bearing system 150 may include one shorter/smaller bearing pad and the remaining may be longer/larger bearing pads. In some embodiments, there may be more than two sizes of bearing pads. For example, the bearing system 150 may include two small bearing pads, two medium bearing pads, and one large bearing pad arranged within the stator 120 in order to load the shaft 56, 60 in a desired manner. It should also be understood that the number of bearing pads 152 may also vary depending the embodiments. For example, the bearing system 150 may include 1, 2, 3, 4, 5, 6, 7, 8, 9, 10, or more bearing pads.

Figure 9:
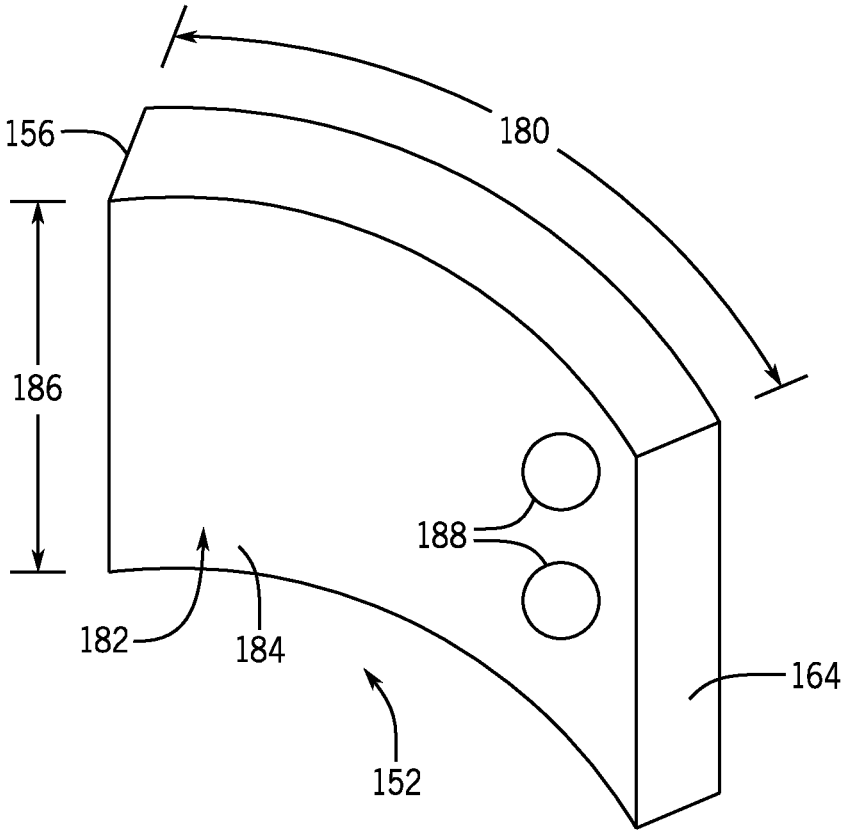
FIG. 9 is a perspective view of a bearing pad, in accordance with an embodiment of the disclosure.

FIG. 9 is a perspective view of a bearing pad 152. As explained above, the size of the bearing pads 152 changes the forces generated by the fluid as it contacts the bearing pads 152. FIGS. 7 and 8 discussed changing a length 180 to change an area 182 of the bearing pads 170, which changes the forces acting on the shaft 56, 60. In addition to changing the length 180, the surface area 182 of a bearing pad face 184 may be adjusted by changing a height 186 of the bearings pads 152 to change the force. In still other embodiments, the force may be changed by including apertures 188 (e.g., 1, 2, 3, 4, 5, 10, 15, or more) in the bearing pads 152. By including apertures 188 in the bearing pads 152, the surface area of the face 184 may be reduced, which again changes (i.e., reduces) the force created by the fluid as it contacts the bearing pads 152. The surface area 182 of the bearing pad faces 184 may therefore change by adjusting the length, height, and/or including apertures to change the pressure gradient created by the fluid contacting the bearing pads 152.

Figure 10:
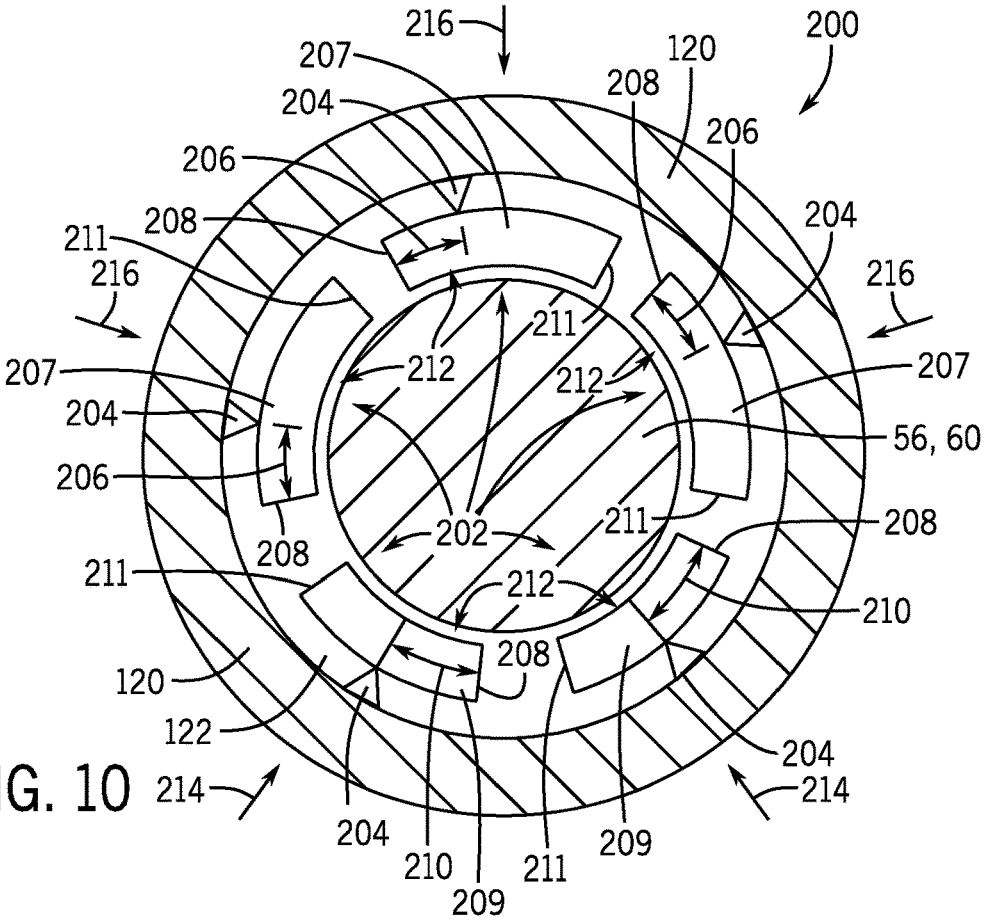
FIG. 10 is a cross-sectional top view of a bearing system for a vertically oriented shaft, according to an embodiment of the disclosure.

FIG. 10 is a cross-sectional top view of a bearing system 200 that uses rotation of the shaft 56, 60 to create a pressure gradient, which drives/biases the shaft 56, 60 in a desired direction. As explained above, the bearing system 150 (illustrated in FIG. 7) drives the shaft 56, 60 towards the bearing pads 170 by decreasing the force generated by the bearing pads 170. More specifically, the bearing pads 170 are shorter than the bearing pads 168, which enables the bearing pads 168 to generate more force than the bearing pads 170. In bearing system 200 (illustrated in FIG. 10), all of the bearing pads 202 are equally sized. In order to bias or drive the shaft 56, 60 in a desired direction, the bearing system 200 shifts the position of one or more of the pivot connectors 204.

As illustrated, some of the bearing pads 202 include pivot connectors 204 that are spaced a distance 206 from a first outermost edge 208 (e.g., counter-clockwise edge). These bearing pads 202 will be labeled with the number 207. The remaining bearing pads 202 couple to the pivot connectors 204 at a distance 210 from the first outermost edge 208. These bearing pads 202 will be labeled with the number 209. The distance 210 is greater than the distance 206, which places the pivot connectors 204 closer to or at the center of the bearing pads 209. In this position, the bearing pads 209 will rotate less about the pivot connectors 204. Less rotation of the bearing pads 209 reduces the difference in the dimensions of the gap 212 between the first outermost edge 208 and the second outermost edge 211 of the bearing pads 202 and the shaft 56, 60. A more uniform gap 212 reduces the pressure gradient and therefore the force generated by the bearing pads 209 in direction 214. In contrast, the bearing pads 207 rotate more than the bearing pads 209 because the distance 206 from the first outermost edge 208 is less. The increased rotation of the bearing pads 207 increases the difference in the dimensions of the gap 212 between the first outermost edge 208 and the second outermost edge 211. A less uniform gap 212 increases the pressure gradient and therefore the force in directions 216 of the bearing pads 207. The difference in the forces created by the bearing pads 207 and 209 biases the shaft 56, 60 towards the bearing pads 209, which loads the shaft 56, 60.

As explained above, the bearing system 200 illustrates two sets of bearing pads (i.e., 207 and 209) with pivot connectors 204 at different distances from the first outermost edge 208. In some embodiments, each bearing pad 202 may couple to a respective pivot connector 204 at a distance that differs from the other bearing pads 202. In still other embodiments, there may be more than two groups of bearing pads with the same distances between the first outer most edges 208 and the pivot connectors 204. It should also be understood that bearing system 200 may include 1, 2, 3, 4, 5, 6, 7, 8, 9, 10, or more bearing pads 202.

Figure 11:
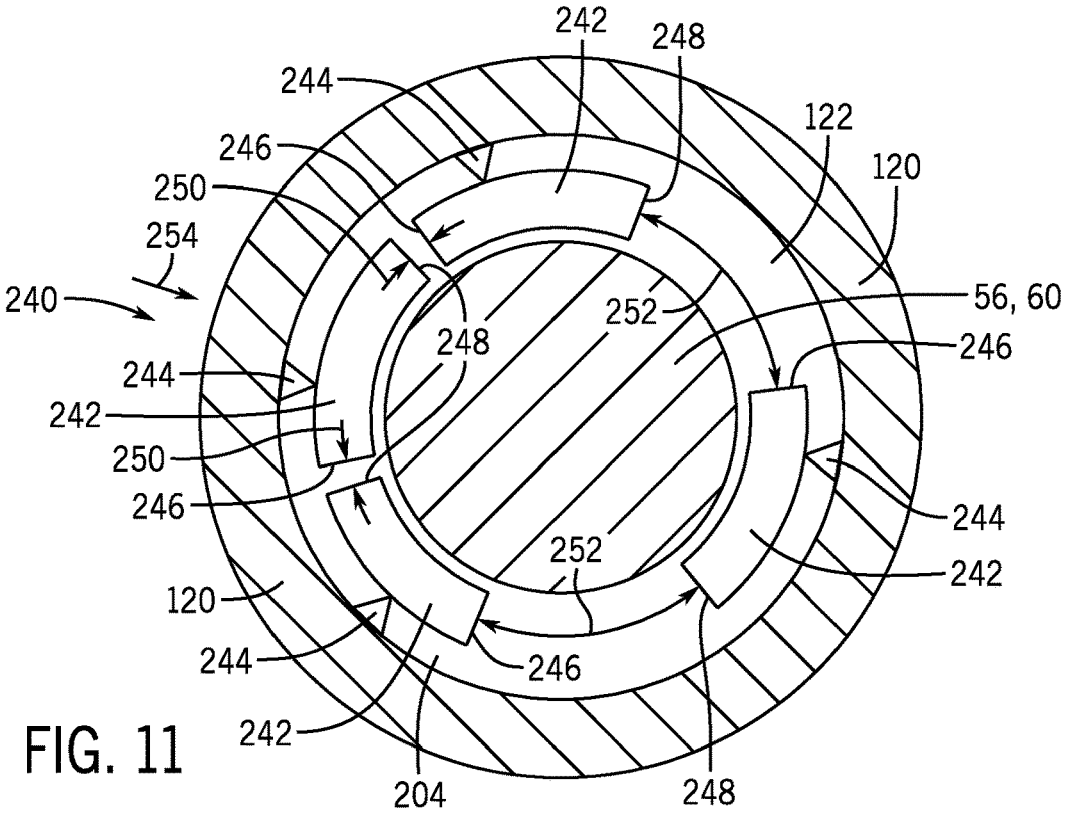
FIG. 11 is a cross-sectional top view of a bearing system for a vertically oriented shaft, according to an embodiment of the disclosure.

FIG. 11 is a cross-sectional top view of a bearing system 240 that uses rotation of the shaft 56, 60 to create a pressure gradient, which drives/biases the shaft 56, 60 in a desired direction. As illustrated, the bearing system 240 includes bearing pads 242 that couple to respective pivot connectors 244. The pivot connectors 244 couple the bearing pads 242 to the stator 120 and enable the bearing pads 242 to rotate. The bearing pads 242 of the bearing system 240 are equally sized and the pivot connectors 244 couple to the bearing pads 242 at the same location relative to the respective first outermost edges 246 (e.g., counter-clockwise edges) or the second outermost edges 248 (e.g., clockwise edges). Accordingly, each bearing pad 242 may generate an equal amount of force. In order to bias the shaft 56, 60, the bearing system 240 varies the spacing between the bearing pads 242. As illustrated, some of the bearing pads 242 are spaced from one another a distance 250 and others a distance 252. The change in spacing between the bearing pads 242 concentrates the forces and biases the shaft 56, 60 in a desired direction. In FIG. 11, three of the bearing pads 242 are spaced close together with one bearing pad 242 spaced further away. In this configuration, the three concentrated bearing pads 242 generate a force that drives or biases the shaft 56, 60 in direction 254 toward the bearing pad 242 (e.g., lone bearing pad 242) spaced from the neighboring bearing pads 242 by the distance 252.

While three bearing system configurations have been discussed above, it should be understood that varying combinations of these configurations may also be possible. Specifically, a bearing system may include one or more of the configurations discussed above in order to bias or load a vertically oriented shaft to reduce and/or block undesirable rotor dynamic effects (e.g., rotor whirl). Specifically, the bearing system may include one or more of the following options: (1) varying the size of the bearing pads; (2) varying the position of the pivot connectors with respect to the bearing pads; and (3) varying the spacing between the bearing pads.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A vertical rotating system, comprising:

a first vertical shaft configured to rotate about a central axis of the first vertical shaft, wherein the first vertical shaft is oriented such that the gravitational force is substantially parallel to the first vertical shaft;

a first impeller section coupled to the first vertical shaft and configured to rotate in a first direction;

a stator surrounding the first vertical shaft; and a plurality of bearing pads that extend circumferentially about the first vertical shaft, wherein the plurality of bearing pads couple to the stator with a respective pivot connector of a plurality of pivot connectors, and wherein the plurality of bearing pads are configured to direct a force created by rotation of the first vertical shaft in a fluid to load the first vertical shaft;

wherein the plurality of bearing pads are equally sized and comprise a first bearing pad, a second bearing pad and a third bearing pad spaced adjacent to one another in a sequence in a circumferential direction, wherein the first bearing pad is circumferentially offset from the second bearing pad by a first distance, and the second bearing pad is circumferentially offset from the third bearing pad by a second distance, wherein the first distance and the second distance are different, and wherein a difference between the first distance and the second distance is configured to direct the force of a fluid to load the first vertical shaft; and wherein the plurality of bearing pads comprises the first bearing pad, the second bearing pad, the third bearing pad, and a fourth bearing pad in the sequence in the circumferential direction, wherein the fourth bearing pad is circumferentially offset from the first bearing pad by a third distance and circumferentially offset from the third bearing pad by a fourth distance, wherein the first distance and third distance are a first common distance, wherein the second distance and the fourth distance are a second common distance, wherein the second common distance is greater than the first common distance, wherein the first, second, and fourth bearing pads are configured to direct the force of the fluid to load the first vertical shaft in a direction toward the third bearing pad.

2. The vertical rotating system of claim 1, comprising a second vertical shaft configured to couple to a second impeller section, wherein the second vertical shaft and the second impeller section are configured to rotate in a second direction that is opposite the first direction.

3. The vertical rotating system of claim 1, wherein at least one bearing pad of the plurality of bearing pads has one or more apertures to change an area of the at least one bearing pad.

4. The vertical rotating system of claim 1, wherein each pivot connector of the plurality of pivot connectors is coupled to a respective bearing pad of the plurality of bearing pads at a common distance from an edge of the respective bearing pad in the circumferential direction.

5. The vertical rotating system of claim 1, wherein the plurality of bearing pads comprises the first bearing pad, the second bearing pad, the third bearing pad, the fourth bearing pad, and a fifth bearing pad in the sequence in the circumferential direction, wherein the fifth bearing pad is circumferentially offset from the fourth bearing pad by a fifth distance and circumferentially offset from the first bearing pad by a sixth distance, wherein the second and fourth distances are greater than the first, fifth, and sixth distances.

6. The vertical rotating system of claim 1, wherein each pivot connector of the plurality of pivot connectors is coupled to a respective bearing pad of the plurality of bearing pads at a common distance from an edge of the respective bearing pad in the circumferential direction, and the common distance is offset from a center of the respective bearing pad in the circumferential direction.

7. A vertical rotating system, comprising:

a first vertical shaft configured to rotate about a central axis of the first vertical shaft, wherein the first vertical shaft is oriented such that the gravitational force is substantially parallel to the first vertical shaft;

a first impeller section coupled to the first vertical shaft and configured to rotate in a first direction;

a stator surrounding the first vertical shaft; and a plurality of bearing pads that extend in a circumferential direction about the first vertical shaft, wherein each of the plurality of bearing pads extends over a length in the circumferential direction from a first edge to an opposite second edge, each of the plurality of bearing pads has a center in the circumferential direction between the first and second edges, and the plurality of bearing pads are equally sized at least in the length;

a plurality of pivot connectors each coupled to a respective one of the plurality of bearing pads, and wherein the plurality of bearing pads are configured to direct a force created by rotation of the first vertical shaft in a fluid to load the first vertical shaft;

wherein each bearing pad in at least a first subset of the plurality of bearing pads has a respective pivot connector of the plurality of pivot connectors positioned at: an offset from the center of the respective bearing pad in the circumferential direction and at a distance away from the second edge, wherein the first subset of the plurality of bearing pads comprises at least one of:

at least three bearing pads of the plurality of bearing pads; or at least two bearing pads of the plurality of bearing pads arranged in a sequence in the circumferential direction.

8. The vertical rotating system of claim 7, wherein the plurality of bearing pads are equally spaced about the first vertical shaft.

9. The vertical rotating system of claim 7, wherein the plurality of bearing pads have a variable spacing between adjacent bearing pads.

10. The vertical rotating system of claim 7, wherein the first subset of the plurality of bearing pads comprises the at least three bearing pads of the plurality of bearing pads.

11. The vertical rotating system of claim 7, wherein the first subset of the plurality of bearing pads comprises the at least two bearing pads of the plurality of bearing pads arranged in the sequence in the circumferential direction.

12. A contra-rotating compressor, comprising:

a first vertical shaft configured to rotate about a first central axis of the first vertical shaft, wherein the first vertical shaft is oriented such that the gravitational force is substantially parallel to the first vertical shaft;

a first impeller section coupled to the first vertical shaft and configured to rotate in a first direction;

a second vertical shaft configured to rotate about a second central axis of the second vertical shaft, wherein the second vertical shaft is oriented such that the gravitational force is substantially parallel to the second vertical shaft;

a second impeller section configured to rotate in a second direction that is opposite the first direction, wherein the first and second impeller sections are axially aligned;

a first bearing system coupled to the first vertical shaft, wherein the first bearing system comprises a first plurality of bearing pads spaced circumferentially about the first vertical shaft and a first plurality of pivot connectors each coupled to a respective one of the first plurality of bearing pads, wherein the first plurality of bearing pads is configured to direct a first force created by rotation of the first vertical shaft in a first fluid to load the first vertical shaft at a first position along a first length of the first vertical shaft; and a second bearing system coupled to the second vertical shaft, wherein the second bearing system comprises a second plurality of bearing pads spaced circumferentially about the second vertical shaft and a second plurality of pivot connectors each coupled to a respective one of the second plurality of bearing pads, wherein the second plurality of bearing pads is configured to direct a second force created by rotation of the second vertical shaft in a second fluid to load the second vertical shaft at a second position along a second length of the first vertical shaft, wherein the first position relative to the first length of the first shaft is different from the second position relative to the second length of the second shaft;

wherein bearing pads in the first bearing system and/or the second bearing system have a variable area defined by a length, a height, and a number of apertures.

13. The contra-rotating compressor of claim 12, wherein the first bearing system and/or the second bearing system has at least one of: (i) a variable spacing between adjacent bearing pads, or (ii) a variable distance between a pivot connector coupled off-center to a respective bearing pad and an edge in a circumferential direction.

14. The contra-rotating compressor of claim 13, wherein the first bearing system and/or the second bearing system has the variable spacing and the variable distance.

15. The contra-rotating compressor of claim 12, wherein, for the first plurality of bearing pads of the first bearing system and/or for the second plurality of bearing pads of the second bearing system, the bearing pads comprise one bearing pad spaced a common distance relative to adjacent bearing pads on circumferentially opposite sides of the one bearing pad, and the common distance is greater than all other distances between adjacent bearing pads.

16. The contra-rotating compressor of claim 12, wherein, for the first plurality of bearing pads and the first plurality of pivot connectors of the first bearing system and/or for the second plurality of bearing pads and the second plurality of pivot connectors of the second bearing system, each bearing pad extends over the length in a circumferential direction from a first edge to an opposite second edge, and each of the bearing pads has a center in the circumferential direction between the first and second edge;

each bearing pad in at least a first subset of bearing pads has a respective pivot connector of the pivot connectors positioned at: an offset from the center of the respective bearing pad in the circumferential direction and at a distance away from the second edge, wherein the first subset of the bearing pads comprises at least one of:

at least three bearing pads; or at least two bearing pads arranged in a sequence in the circumferential direction.

17. The contra-rotating compressor of claim 12, wherein the first bearing system and/or the second bearing system has a variable spacing between adjacent bearing pads and a variable distance between a pivot connector coupled off-center to a respective bearing pad and an edge in a circumferential direction.

* * * * *